US009453709B2

(12) United States Patent
Hamm et al.

(10) Patent No.: US 9,453,709 B2
(45) Date of Patent: Sep. 27, 2016

(54) GUN SIGHT MOUNTING SYSTEM

(71) Applicants: Harold M. Hamm, Wisconsin Rapids, WI (US); Brian H. Hamm, Wisconsin Rapids, WI (US); Christopher A. Hamm, Wisconsin Rapids, WI (US)

(72) Inventors: Harold M. Hamm, Wisconsin Rapids, WI (US); Brian H. Hamm, Wisconsin Rapids, WI (US); Christopher A. Hamm, Wisconsin Rapids, WI (US)

( * ) Notice: Subject to any disclaimer, the term of this patent is extended or adjusted under 35 U.S.C. 154(b) by 0 days.

(21) Appl. No.: 14/061,216

(22) Filed: Oct. 23, 2013

(65) Prior Publication Data

US 2014/0123536 A1 May 8, 2014

Related U.S. Application Data

(60) Provisional application No. 61/718,474, filed on Oct. 25, 2012.

(51) Int. Cl.
*F41G 1/38* (2006.01)
*F41G 11/00* (2006.01)

(52) U.S. Cl.
CPC ..... *F41G 11/003* (2013.01)

(58) Field of Classification Search
CPC ..... F41G 1/28; F41G 1/387; F41G 11/001; F41G 11/003
See application file for complete search history.

(56) References Cited

U.S. PATENT DOCUMENTS 906,751 A * 12/1908 Swasey ..... F41G 1/28 42/126
1,330,002 A * 2/1920 Price ..... F41G 1/28 42/136
2,155,391 A * 4/1939 Arden ..... F41G 1/28 42/125
4,961,265 A * 10/1990 Roberts ..... F41G 1/467 124/87
7,475,485 B1 * 1/2009 Hamm ..... F41G 1/467 124/87
8,240,075 B1 * 8/2012 Mullin ..... F41G 1/38 42/119
8,528,140 B1 * 9/2013 Phillips ..... F41G 11/003 12/111
2003/0051386 A1 * 3/2003 Holler ..... F41G 11/007 42/125
2006/0179704 A1 * 8/2006 Dextraze ..... F41G 1/393 42/126
2009/0307956 A1 * 12/2009 Barret ..... F41G 11/003 42/125
2010/0162611 A1 * 7/2010 Samson ..... F41G 1/18 42/125
2012/0279107 A1 * 11/2012 Hoel ..... F41G 11/003 42/90

FOREIGN PATENT DOCUMENTS

GB 191018847 A * 0/1911 ..... F41G 1/3935

* cited by examiner

*Primary Examiner* — Gabriel Klein
(74) *Attorney, Agent, or Firm* — Shane Delsman; Godfrey & Kahn, S.C.

(57) ABSTRACT

A gun sight mounting system for easily and reliably adjusting a sight with respect to a gun barrel. The system has a rail with a first post, and a base with a second post and a window. The first post extends through the window. The rail is adjustably connected to the base. A wheel is provided with a groove for engaging the first post and a hole for engaging the second post. The groove has a spiral or eccentric or cam-like radius such that when the wheel is rotated, the engagement between the first post and the groove causes the relationship between the rail and the base to be adjusted. A measurement system is indicated on the wheel, or on at least one spool that can be mounted to the wheel. At least one tape can be attached to the spool, and can include a measurement system.

3 Claims, 13 Drawing Sheets

GUN SIGHT MOUNTING SYSTEM

CROSS REFERENCE TO RELATED APPLICATION

This application claims the benefit of U.S. Provisional Patent Application Ser. No. 61/718,474, filed Oct. 25, 2012, the disclosure of which is hereby incorporated by reference herein in its entirety for all purposes.

FIELD OF THE INVENTION

This invention relates to sight mounts for firearms. More specifically, this invention relates to systems for mounting telescopic sights to firearms and being adjustable as to angle.

BACKGROUND OF THE INVENTION

Shooting a gun places a premium on accurate direction of a bullet to a target. Although most guns have sights, many avid shooters mount a scope onto the gun in order to obtain better accuracy at longer distances. A shooter may sight in a gun with a scope accurately at a given distance. Once the gun is sighted-in, however, accuracy will be reduced if the distance between the shooter and the target changes, compared to the sighted-in distance. This loss of accuracy is because the flight of a bullet follows a curve, with the maximum height somewhere between the gun and target, depending on shooting distance. The shooter will need to adjust the scope up or down in relation to the barrel of the gun to hit a target at varying distances. There is therefore a need for a mounting apparatus that allows the shooter to easily adjust from one distance to other distances.

Adjustable sighting systems are known in the archery industry. For example, U.S. Pat. No. 7,475,485 by the inventors of the present application, discloses a yardage tape apparatus wherein a set-up tape and dial is used to sight in an archery bow. From the sight in process, a yardage tape is determined. The identified yardage tape is then applied to the dial and used in subsequent use in shooting the archery bow. However, there are substantial differences between the requirements for accurately shooting an archery bow and a gun. One such difference is the target distance, wherein archery generally consists of shooting at closer targets than guns. Another difference is the trajectory of the arrow versus a bullet, wherein the trajectory of a bullet is a flatter line. Another difference is that adjustment of a sight has a greater impact on accuracy of a bullet based in part upon the difference in distance and trajectory. Therefore, there is a need for a mounting apparatus that provides finer adjustment and greater accuracy for guns.

Other changing external factors also affect the accuracy of a previously sighted-in gun with scope. Some external factors that can affect bullet accuracy include but are not limited to the bullet shape, weight and velocity, altitude, humidity, temperature, wind and atmospheric pressure to name a few. Avid shooters may use tables, equations and/or software to appropriately consider all of these factors in order to obtain the adjustments necessary for accuracy under the current shooting conditions. However, correctly adjusting for the multitude of factors that can affect bullet accuracy is complex, time consuming and can result in the desired target getting away. Therefore, there is a need for an affordable mounting apparatus that allows a shooter to easily make adjustments based upon changes in ammunition or environmental factors.

Further, shooting equipment, such as scopes or shooting software, that can account for a significant number of the factors that affect shooting accuracy, can be costly. Although it may be desirable to be able to use one scope on multiple guns, switching the scope between guns can require sighting in the scope each time the scope is taken off and mounted again. Many shooters simply buy a scope for each gun, thereby adding expense. Therefore, there is a need for an affordable mounting apparatus that can be easily switched between guns while reducing the sight in process when the apparatus is switched between guns.

SUMMARY OF THE INVENTION

The invention provides a gun sight mounting system wherein the angle of the sight is easily adjustable. In one embodiment, the system has a rail with a first post extending therefrom and a base with a second post extending therefrom. The base has a window formed therein, and the first post extends through the window. The rail is connected to the base such that the rail may be adjusted with respect to the base. A wheel is provided with a groove for engaging the first post and a hole for engaging the second post. The groove has a spiral or eccentric radius such that when the wheel is rotated, the engagement between the first post and the groove has a cam-like function, causing the rail to be adjusted with respect to the base. A measurement system is indicated on the wheel, or on at least one spool that can be mounted to the wheel. At least one tape can be attached to the least one spool, and can include a measurement system. An indicator is mounted such that a specific measurement of the measurement system can be identified. The indicator may magnify the specific measurement such that the specific measurement can be more easily identified.

An adjustable nut engages the second post and can be tightened to prevent the wheel from rotating and loosened to allow the wheel to rotate. A second nut, such as a square nut, has a central hole that engages the second post and secures the wheel on the second post while still allowing the wheel to rotate. A break extends from the central hole to a first side of the square nut such that a first and second leg are formed. A bore is formed in a second side of the square nut adjacent the first side, and continues through the first leg and into the second leg. A screw is threaded into the bore and causes the first and second legs to come together around the second post, securing the square nut on the second post. A washer with a square opening sized to fit over the square nut is placed around the square nut such that, when the adjustable nut is tightened, it contacts the washer and prevents the wheel from rotating. When loosened, it frees the washer allowing the wheel to rotate. A shaft bearing is attached to the end of the first post and sized to fit within the groove of the wheel. A post base engages the first post and sized to fit within the window, with the sides of the post base contacting the sides of the window so as to prevent lateral movement.

These and other features and advantages of one exemplary embodiment of a gun sight mounting system in accordance with this invention are described in, or are apparent from, the following description and accompanying Figures.

DETAILED DESCRIPTION OF THE PREFERRED EMBODIMENTS

Figure 1:
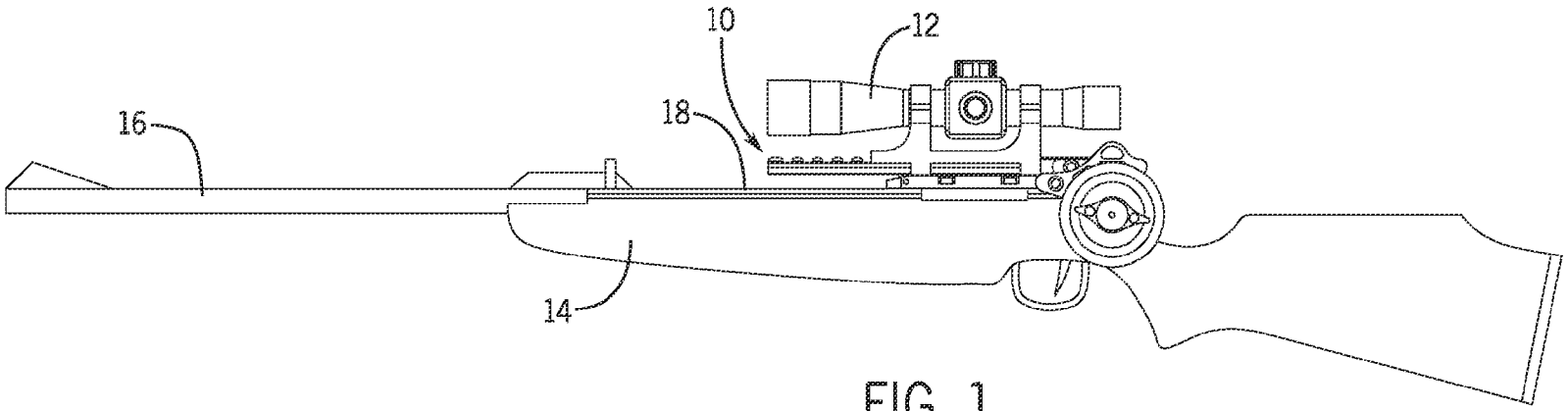
FIG. 1 is a side elevation view of a gun having mounted thereto a telescopic sight, by means of a mounting system according to a preferred embodiment of the present invention.
Figure 2:
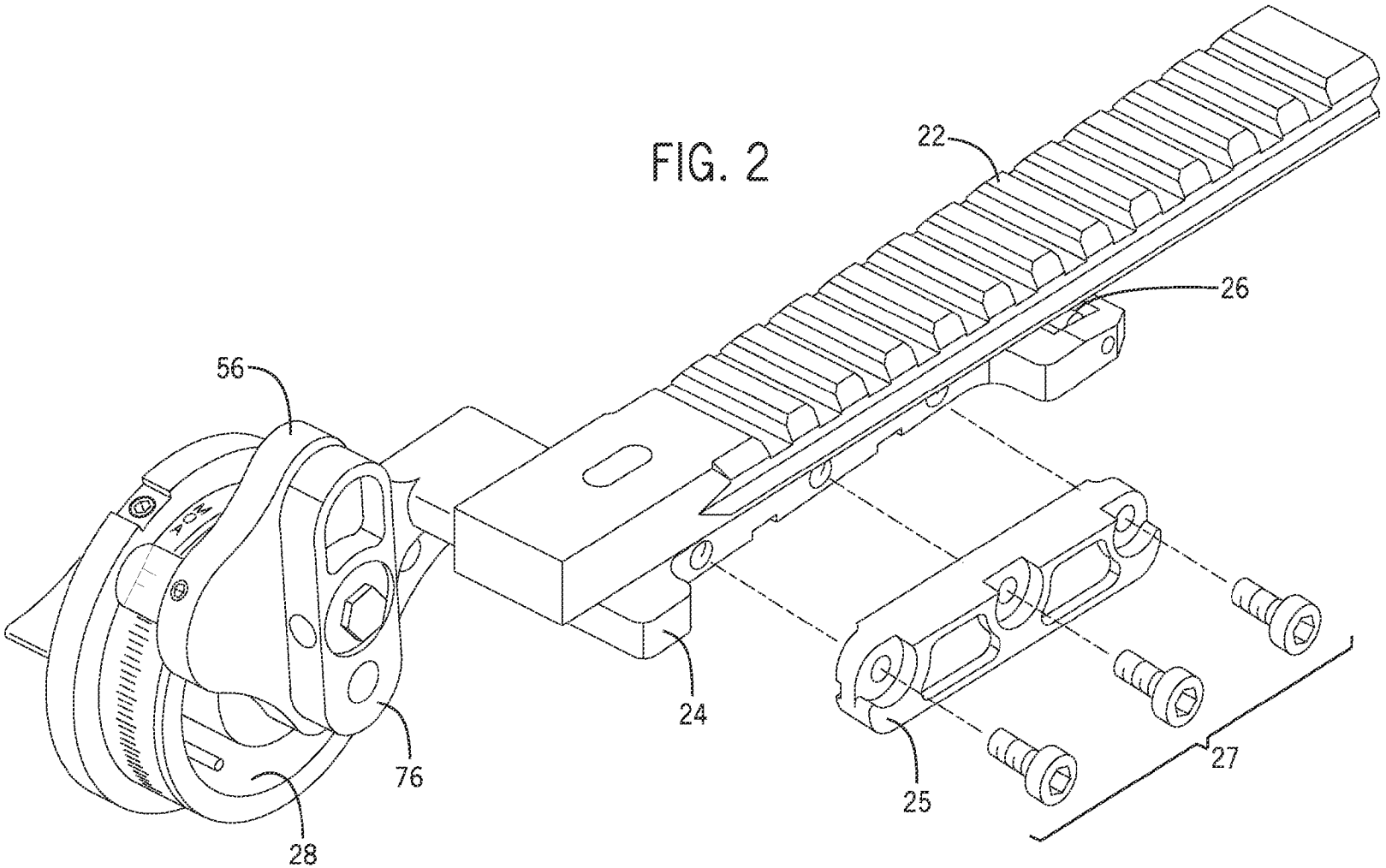
FIG. 2 is an exploded isometric view of the base of the sight mounting system showing how the mounting system attaches to a gun.
Figure 3:
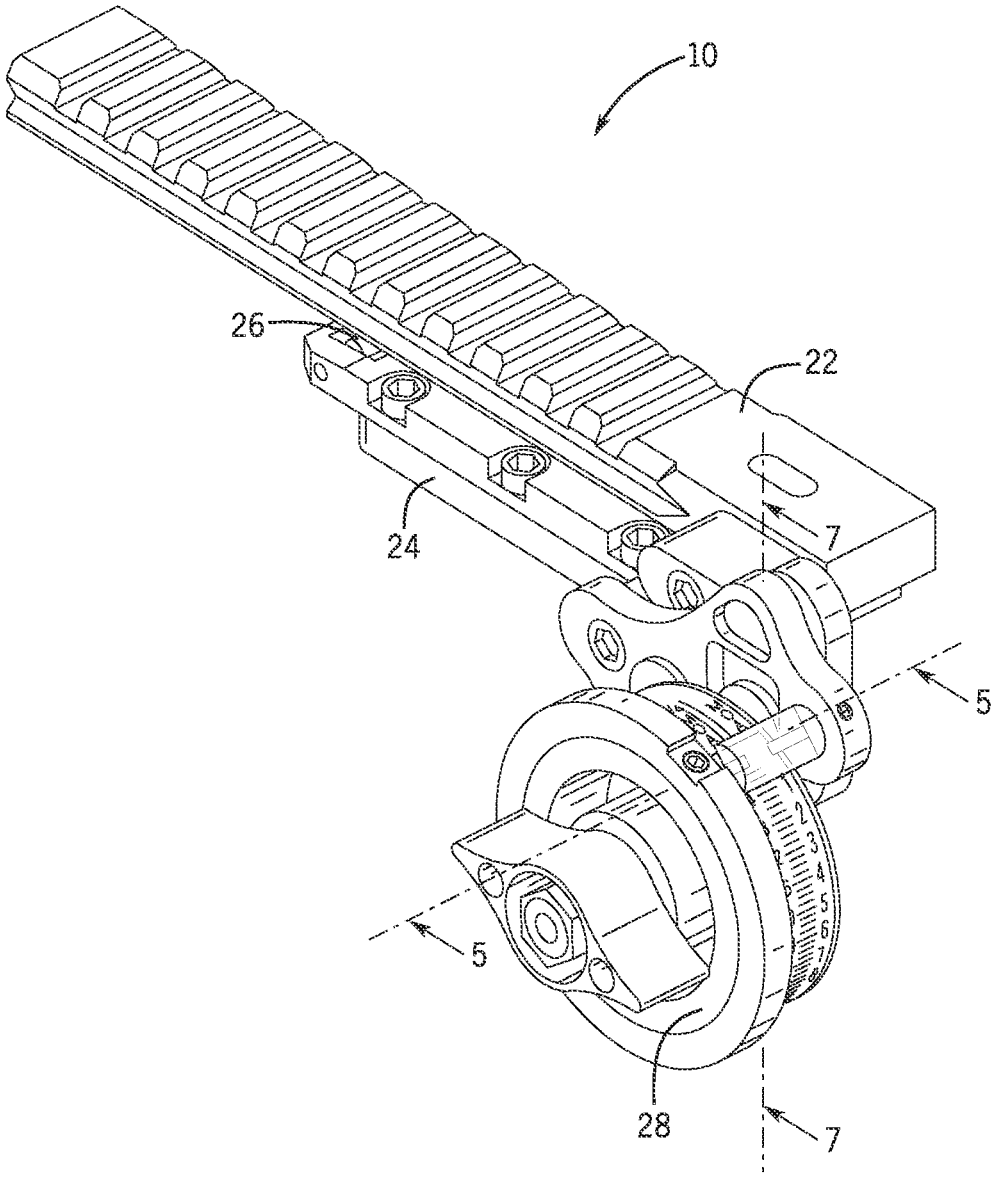
FIG. 3 is an isometric view of a sight mounting system according to one embodiment of the present invention.

As shown in FIG. 1, the present invention provides a system 10 for adjustably mounting a telescopic sight 12 to a gun 14. Preferably, the system is mounted to the barrel 16 of the gun 14, or to the existing sight rail 18 on the barrel 16 by generally conventional means. As seen in FIGS. 2 and 3, the system includes a base 24 longitudinally mounted to the barrel 16 or existing sight rail 18 (FIG. 1), and a rail 22 mounted to the muzzle end of the base 24 by means of a pivotable mounting 26. In one embodiment, the base 24 has at least one adjustable portion 25 which is secured by any known means, but in this example, screws 27. To mount the system 10 on a gun 14, the screws 27 are loosened so that the adjustable portion 25 may be slid onto the sight rail 18 of a gun 14 and then the screws 27 are tightened so that the system 10 is secured to the gun 14. To the rail 22 is mounted the shooter's telescopic sight 12 as seen in FIG. 1. This allows the system 10 to be easily mounted to and dismounted from any number of guns.

The system 10 further includes a cam mechanism which permits the raising and lowering of the breech end of the rail 22, by rotating a wheel 28. As will be explained in further detail below, the amount by which the breech end of the rail 22 is raised above the breech end of the base 24 is determined by the rotational position of the wheel 28.

Figure 4:
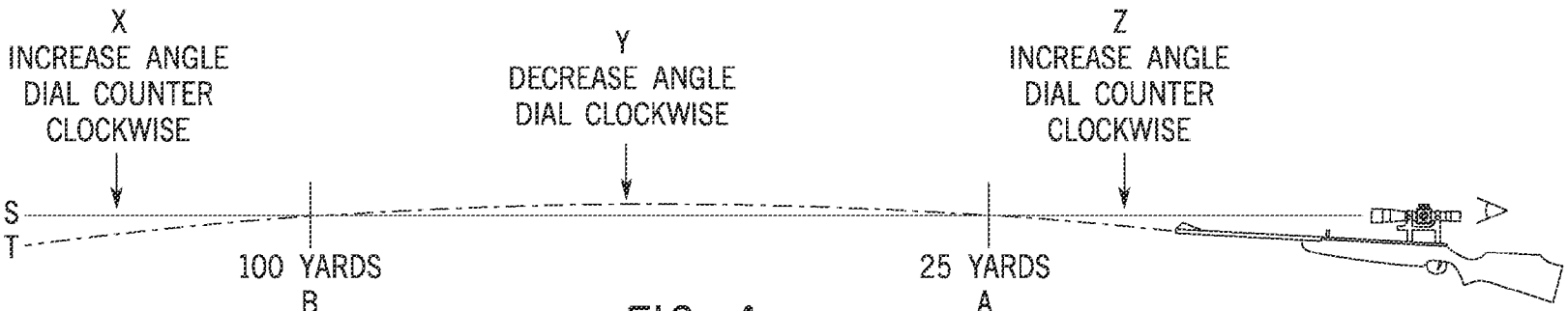
FIG. 4 is a diagrammatic representation of the problem, experienced by shooters, brought about by the separation between the line of sight of the telescopic sight and the path of travel of the projectile expelled from the gun.

As shown in FIG. 4, a shooter is always confronted by two issues: (1) that the sight of any gun is offset from the bore of the barrel of the gun; and (2) that the path of flight of the projectile expelled from the gun is a curve, whereas a sight line is a straight line. The combination of these two factors means that the angle of the sight with respect to the barrel needs to be changed depending on the distance of the target from the muzzle of the firearm. At any one elevation setting of the sight, the sight line S of the sight itself and the trajectory T of the projectile may coincide at two points, A and B, in the example given 25 yards and 100 yards. If the target is in the areas X and Z outside of those points, in the example given 0 to 25 yards or more than 100 yards, the sight must be lowered in order to get the sight line S to coincide with the trajectory T, and thus hit the target. If the target is in the area Y between those points, in the example given between 25 yards and 100 yards, the sight must be raised, in order to get the sight line S to coincide with the trajectory T, and thus hit the target. In hunting and target shooting, adjustments to this angle must be made in order to account for these two issues. The present invention provides an easy and simple system to provide those angle adjustments.

Figure 5:
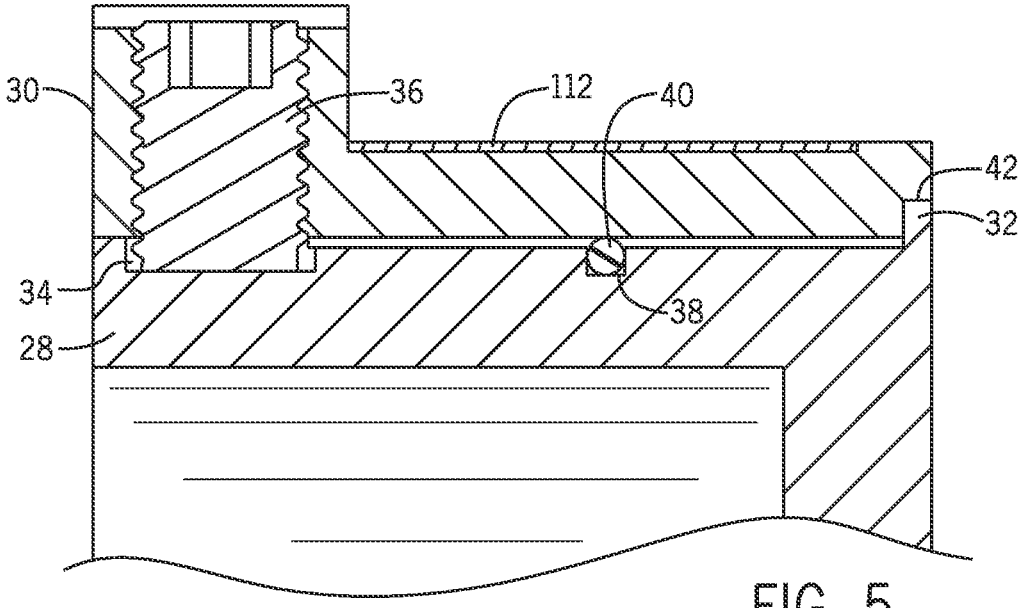
FIG. 5 is a sectional view of FIG. 3, taken along line 5-5.

According to the system of the present invention, multiple different spools 30 such as a calibration spool 30*a* and a yardage spool 30*b* may be applied to the wheel 28. The wheel 28 and each spool 30 are sized relative to each other so that the spool 30 slip-fits over the wheel 28. As seen in FIG. 5, the wheel 28 has an inner lip 32. The wheel 28 also has an outer groove 34 adapted for accepting the set screw 36 from the spool 30 and a middle groove 38 adapted for placement of an O-ring 40. The spool 30 is slid onto the wheel 28 until the cut out 42 of the spool 30 contacts the lip 32 of the wheel 28. Once slip-fitted on, the spool 30 is affixed to the wheel 28 by any suitably rigid but removable means, such as one or more set screws 36 which are threaded through the spool 30 and come into contact with the outer groove 34 of the wheel 28. As the set screw 36 is tightened and the spool 30 is drawn to the wheel 28, the O-ring 40 is compressed to ensure a strong engagement between the wheel 28 and spool 30 and also to prevent any structural damage or deflection to the wheel 28 or spool 30 from over-tightening of the set screw 36. That way, once so attached, the wheel 28 and spool 30 rotate as a unit.

Figure 6:
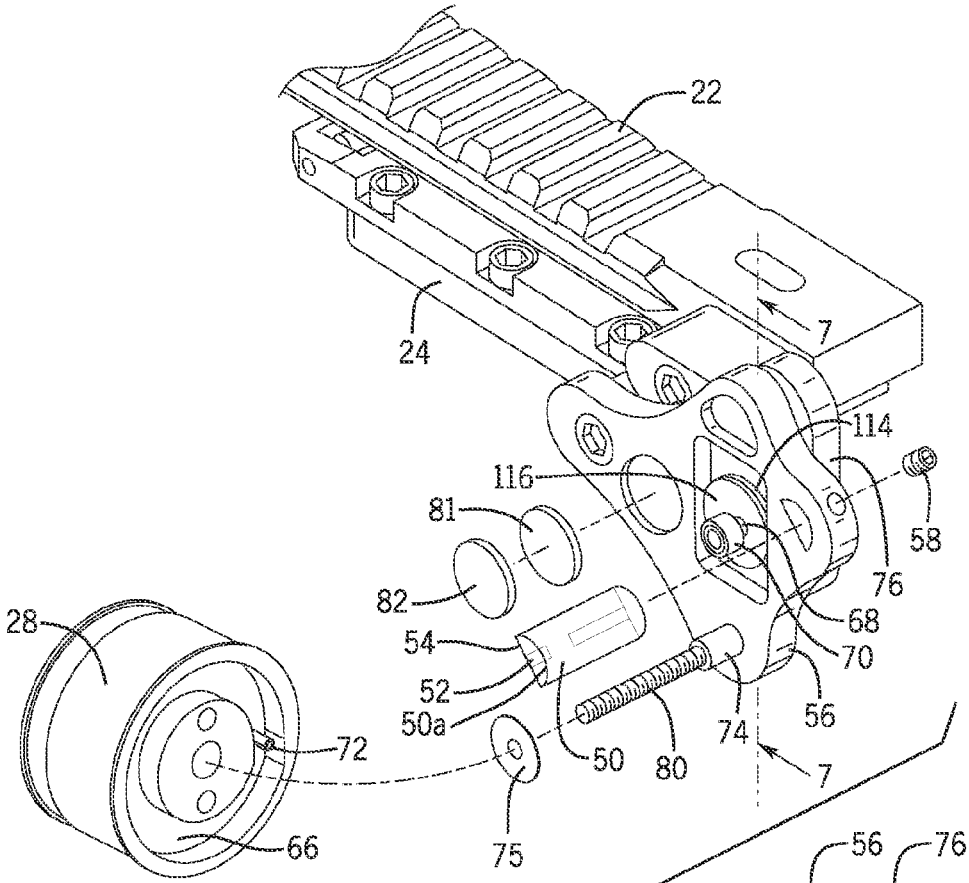
FIG. 6 is an exploded isometric view of the sight mounting system shown in FIG. 3.

As seen in FIG. 6, a magnifying prism 50 is positioned so as to extend over the side wail of the wheel 28, at a distance of separation from the wheel 28 sufficient to accommodate the thickness of the spool 30. The prism 50 has a convex surface 50*a* and an opposite flat surface 54, and thus magnifies in one direction only. Prism 50 includes a line 52 on the flat surface 54 closest to the spool 30. The magnifying prism 50 permits the user to differentiate much smaller increments of distance and make very small adjustments to the rotational position of the spool 30, and therefore the wheel 28 and ultimately in the entire sighting system 10, due to the extreme level of accuracy afforded by the mounting system. In the embodiment shown, the prism 50 is connected to the same bracket as the wheel 28 so as to assume that position. Specifically, the prism 50 is set into a recess of the base bracket 56 and held in place with a set screw 58 threaded through the base bracket 56 and contacting the curved surface 50*a* of the prism 50, as shown in FIG. 6. Other mountings of the prism 50 are also possible.

Figure 8:
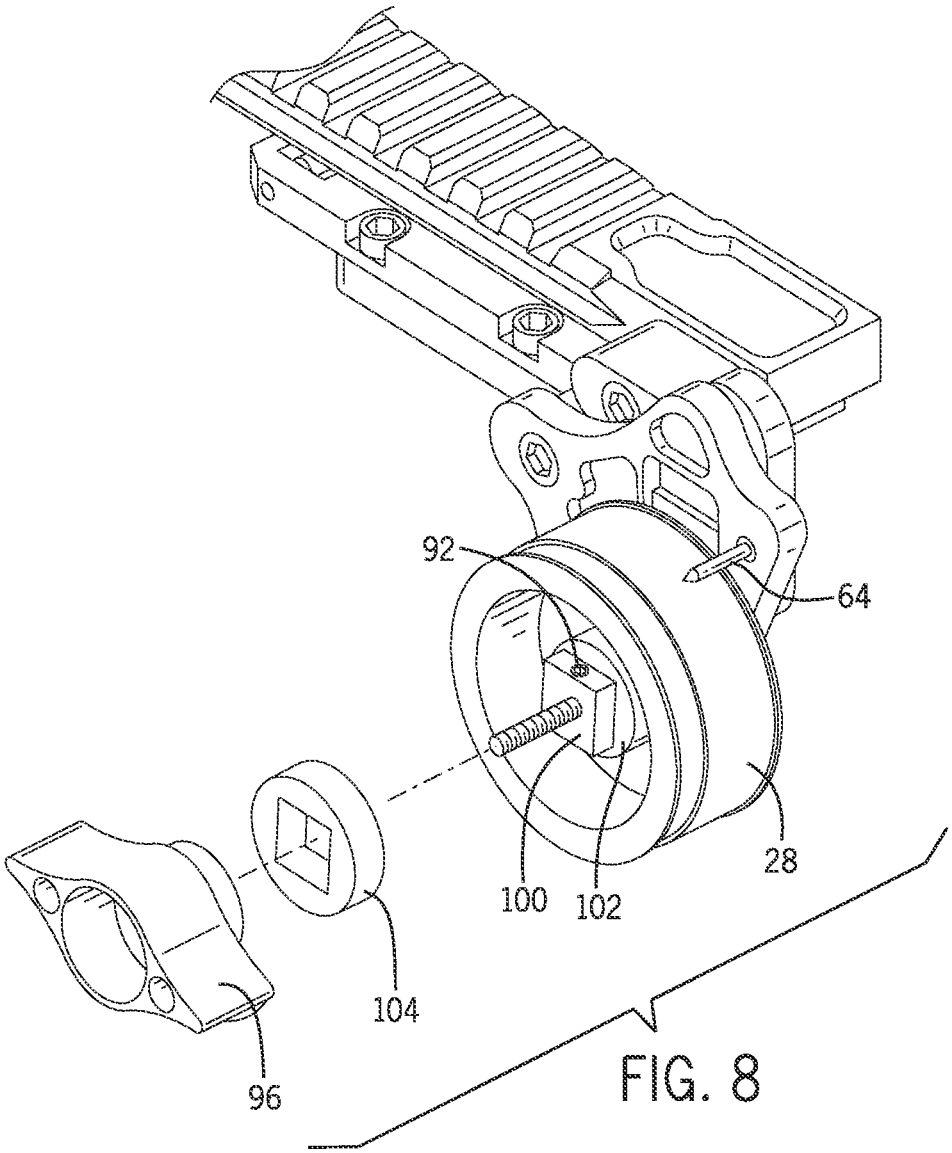
FIG. 8 is an exploded isometric view of a sighting system according to alternative embodiment of the present invention.

FIG. 8 shows an alternative embodiment of the present invention where the magnifying prism 50 is replaced with an indicator pin 64. The indicator pin 64 is positioned so as to extend over the side wall of the wheel 28, at a distance of separation from the wheel 28 sufficient to accommodate the thickness of the spool 30. In the embodiment shown, pin 64 is connected to the same bracket as the wheel 28, but other connections are also possible within the scope of the invention.

Figure 7:
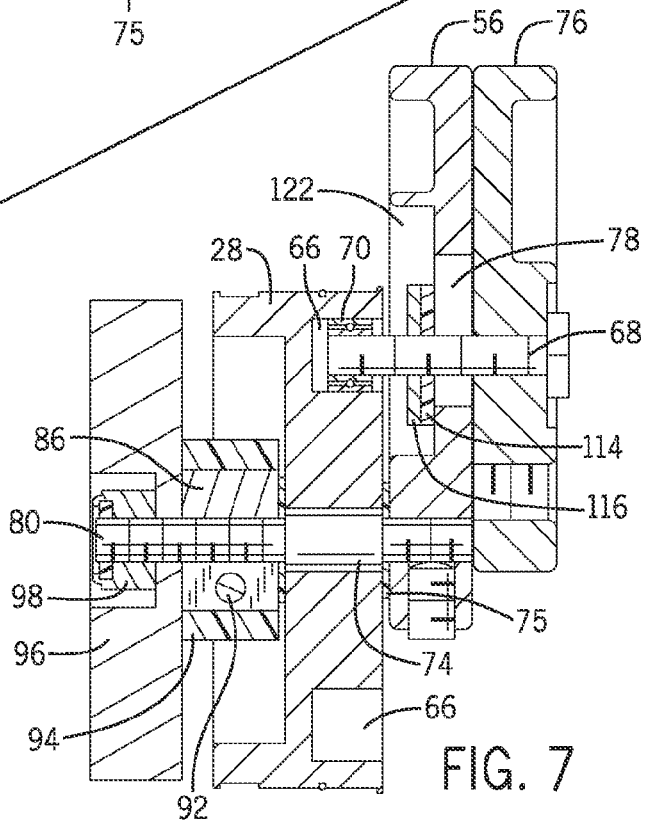
FIG. 7 is a sectional view of the sight mounting system shown in FIG. 3, taken along lines 7-7.
Figure 18:
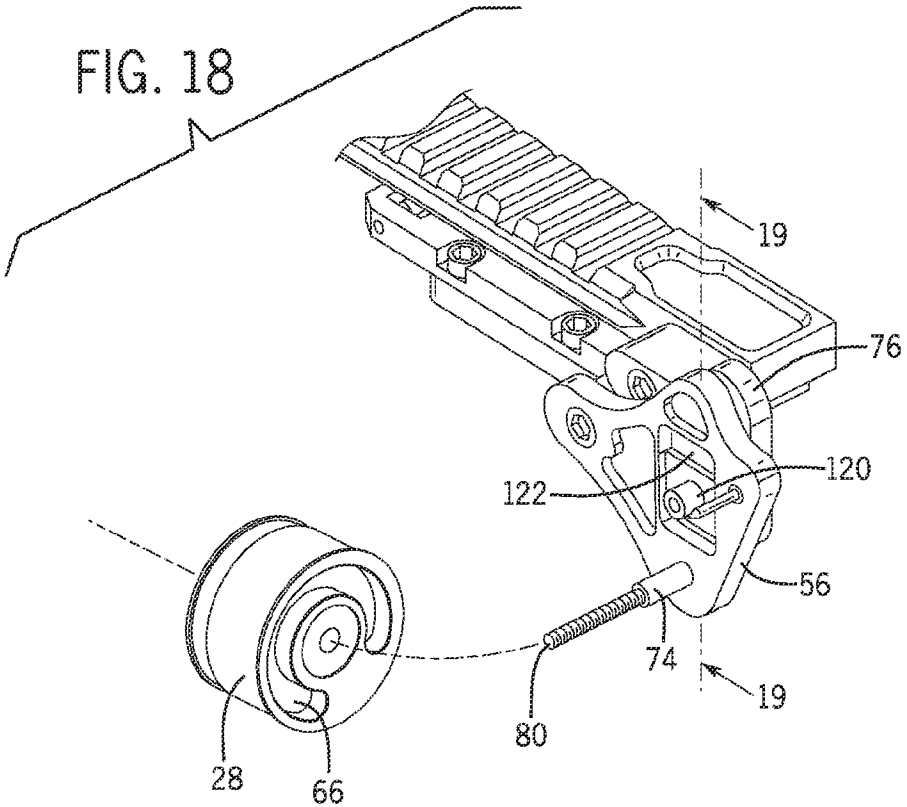
FIG. 18 is an alternate partial exploded isometric view of the sight mounting system shown in FIG. 8.

As described briefly above, the amount by which the breech end of the rail 22 is raised above the base 24 is determined by the rotational position of the wheel 28. To accomplish this functionality, the system 10 includes a cam mechanism which permits the raising and lowering of the breech end of the rail 22. The cam mechanism includes the wheel 28 having a spiral or eccentric groove 66 which engages with a cam follower 68 with a shaft bearing 70 as seen in FIGS. 6 and 7. The wheel 28 is rotatably mounted to the base 24, in a manner described in more detail below, whereas the cam follower 68 is connected to the breech end of the rail 22. The groove 66 may comprise a continuous ring with a pin stop 72 as seen in FIG. 6, a ring with a partial annular groove (as seen in FIG. 18) or any other structure that provides a cam-like functionality within the spirit of the invention.

In the embodiment shown in FIGS. 6 and 7, the wheel 28 is rotatably mounted to a base bracket 56 by being mounted on a peg 74 affixed to the base bracket 56 of the base 24, preferably with washer 75 therebetween. The cam follower 68 is mounted to a rail bracket 76 of the rail 22. The cam follower 68 extends through a window 78 formed for that purpose in the base bracket 56 and has a shaft bearing 70 attached to the end of the cam follower 68 so as to engage the groove 66. An inner portion of the shaft bearing 70 does not rotate with respect to the cam follower 68, and thereby provides a secure connection to the end of the cam follower 68, while the outer surface of the shaft bearing 70 freely rotates, such as on bail bearings, so as to provide a smooth movement in the groove 66. The groove 66 is eccentric or cam-like in that one end of the groove 66 has a shorter radius with respect to the wheel 28 than the other end of the groove 66, and the transition from the one radius to the other is a smooth transition. Thus, with the shaft bearing 70 of the cam follower 68 engaged in the groove 66, rotating the wheel 28 will result in the rail bracket 76 moving with respect to the base bracket 56, and hence the rail 22 will move with respect to the base 24. The base bracket 56 does not move in response to rotation of the wheel 28 because the wheel is mounted to the peg 74 which is in turn mounted to the base bracket 56. The window 78 permits space for the cam follower 68 to freely move up and down within it.

As shown in FIGS. 6 and 7, the peg 74, to which the wheel 28 is rotatably mounted, terminates in a threaded post 80. The mounting of the wheel 28 to the peg 74 must be extremely certain and wear proof so that as the wheel 28 is rotated a certain amount with respect to the base bracket 56, and therefore the rail bracket 76 is moved with respect to the base bracket 56, the angle of the rail 22 is changed with respect to the angle of the base 24 by always an exactly predictable amount. Partly to accomplish that goal, in order to act as a brake, a silicone washer 82 is positioned into an appropriately sized opening in the base bracket 56 (optionally underlaid by a metal washer 81), although washers of other materials may also be used. The hole in the base bracket 56 is sized shallow enough such that the silicone washer 82 protrudes from the base bracket 56 and contacts the wheel 28 to apply friction to the wheel 28 so as to ensure that the wheel 28 turns in a smooth and consistent manner, and the friction allows the spool 30 to adjusted at very small increments. A metal washer 81 of a different thickness, or removing the metal washer altogether, and/or a silicone washer 82 of a different thickness, can be used to adjust the amount of friction applied by the silicone washer 82 to the wheel 28.

Figure 9:
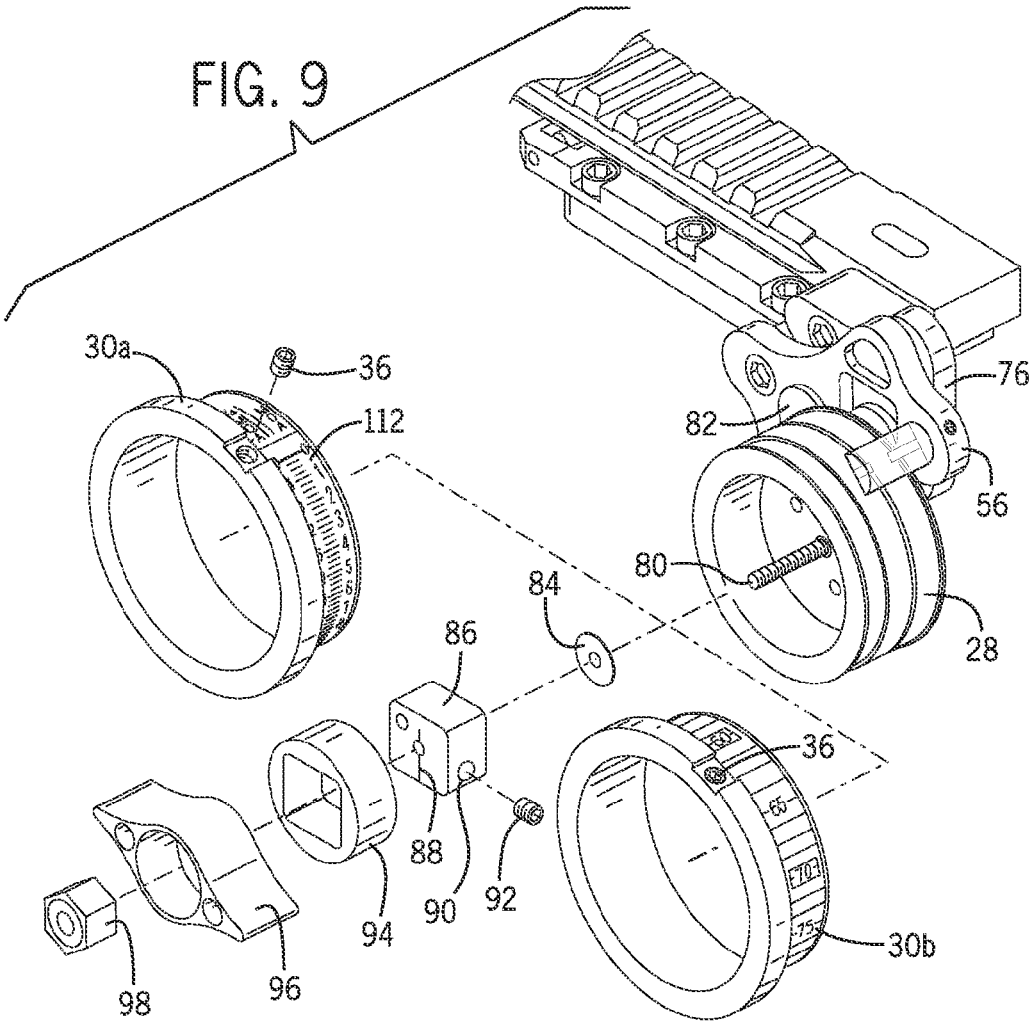
FIG. 9 is an exploded isometric view of a portion of the sight mounting system shown in FIG. 3, showing the wheel attachment and illustrating that at least two different spools may be applied.

One embodiment for accomplishing the desired level of certainty in the mounting is shown in FIG. 9, wherein the wheel 28 is slide mounted to the peg 74 and from which the threaded post 80 protrudes. A washer 84 is applied, and then a square nut 86 is threaded onto the thread post 80 and tightened so that the washer 84 contacts the wheel 28. The square nut 86 has a break 88 from a first side to the center threaded opening and an opening 90 for an inset screw 92 on a second side adjacent to the first side. The opening 90 on the second side of the square nut extends through the square nut 86 and past the break 88 such that when the square nut 86 is threaded onto the thread post 80 and in its final position, the inset screw 92 may be threaded into the opening 90 on the first side of the square nut 86 and tightened thereby pinching the portion on each side of the break 88 around the threaded post 80. The length of the peg 74 is short enough, with respect to the thickness of the wheel 28, that the square nut 86 does not contact the peg when tightened. The wheel 28 will still be rotatable, with a certain substantial amount of friction, when the square nut 86 is tightened on the threaded post 80. A thrust washer 94, having a square opening that generally matches in size the size of the square nut 86, is then applied over the square nut 86, and a wing nut 96 is then threaded onto the threaded post 80. When the wing nut 96 is tightened, the thrust washer 94 will be pushed towards the wheel 28 and the friction applied thereby will be increased to the extent that the wheel 28 will be prevented from rotating. A hex nut 98 is threaded onto the threaded post 80 to maintain the wing nut 96 on the threaded post 80.

In order to adjust the rotational position of the wheel 28, and the spool 30 mounted thereon (and thereby change the positions of the base and rail with respect to each other), the user would loosen the wing nut 96, rotate the spool 30 (and accompanying wheel 28) as desired, and re-tighten the wing nut 96. The use of the thrust washer 94 around the square nut 86 focuses the small amount of contact friction from turning the wig nut 96 to loosen and tighten the wheel 28 on the thrust washer 94 instead of the square nut 86 and thus prevents such friction from loosening the square nut 86. This allows the system to be more accurate by eliminating any wiggle or play from the square nut 86 and thus the wheel 28.

In an alternate embodiment, as shown in FIG. 8, a square nut 100 is threaded onto the threaded post 80, seated within a thrust washer 102 with a square opening sized so as to just fit over the square nut 100. Once tightened, the square nut 100 is set in place by means of a inset screw 92 that engages the threaded post 80. Thereafter, a matching thrust washer 104, again with a square opening sized so as to just fit over the square nut 100, is applied over the square nut. Finally, the wing nut 96 is threaded onto the threaded post 80.

Figure 11:
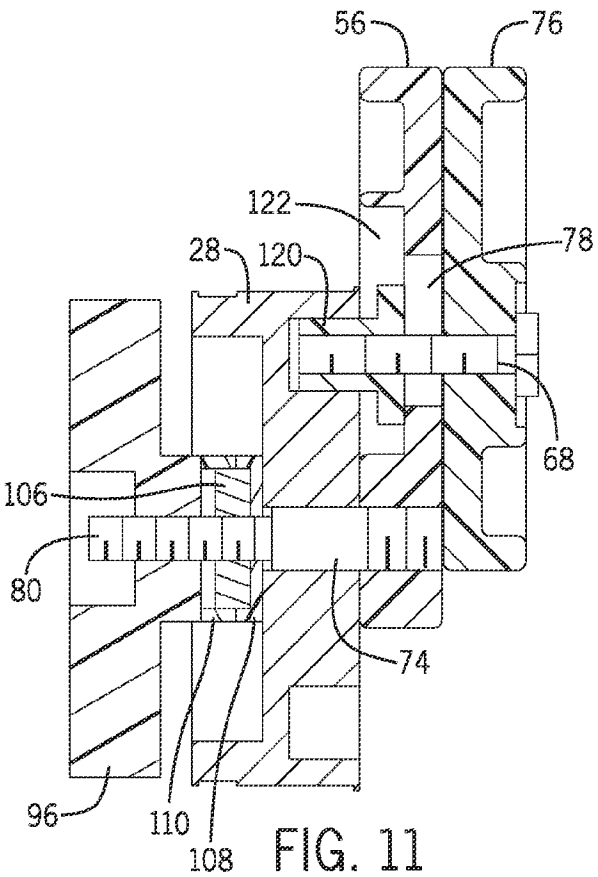
FIG. 11 is a sectional view of the sight mounting system shown in FIG. 10, taken along lines 11-11.
Figure 10:
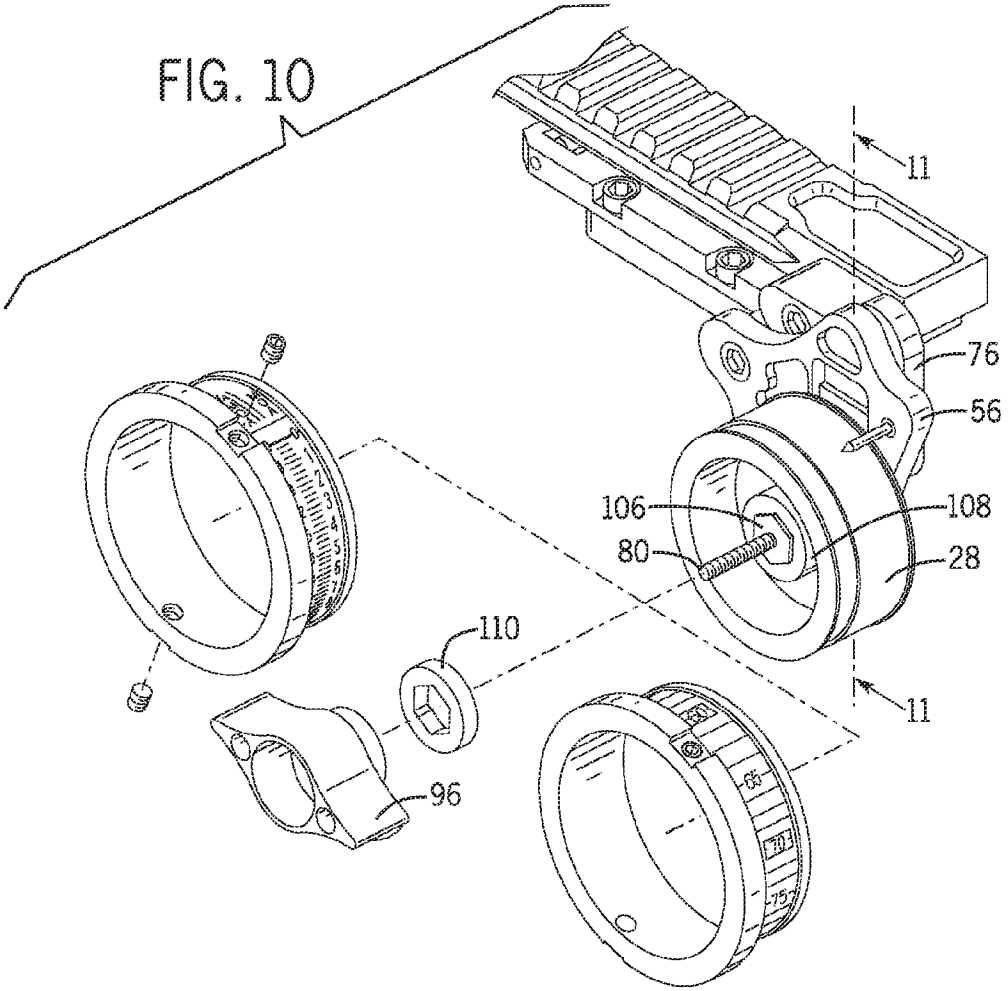
FIG. 10 is an exploded isometric view of a sight mounting system according to an alternate embodiment of the present invention.

In another embodiment seen in FIGS. 10 and 11, a hex nut 106, mounted within a thrust washer 108 with a six-sided opening, is threaded onto the threaded post 80 and tightened so that the thrust washer 108 contacts the wheel 28. A thrust washer 110, having a six sided opening that generally matches in size the hex nut 106, is then applied over the hex nut 106, and a wing nut 96 is then threaded onto the threaded post 80.

As indicated, the tightening of the square nut 86, 100 or hex nut 106 is intended to hold the wheel generally in place, but permit rotation. The application and tightening of the wing nut 96 will prevent rotation of the wheel 28, once the sighting has been set up.

Figure 12:
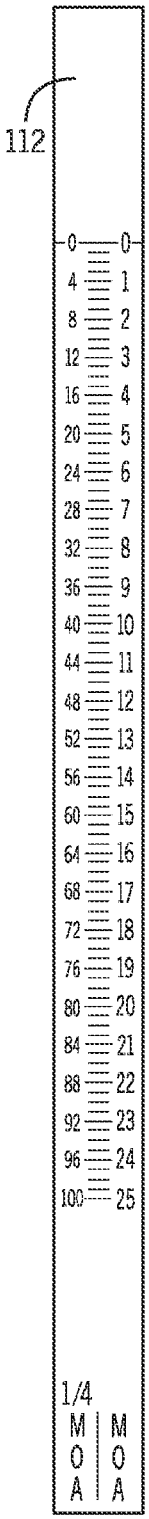
FIG. 12 is a view of a calibration tape to be used with the present invention.
Figure 13A:
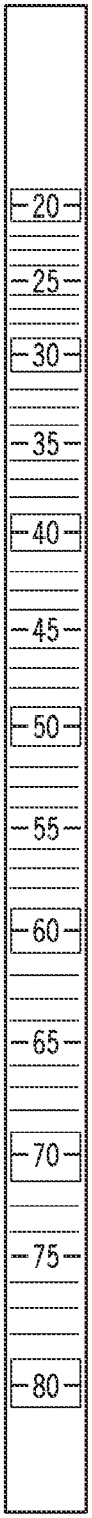
FIGS. 13A through 13D are views of four different yardage tapes to be used with the present invention.
Figure 13B:
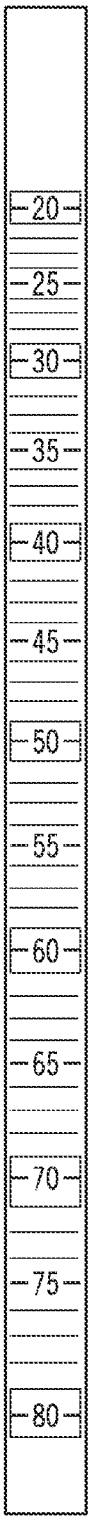
Figure 13C:
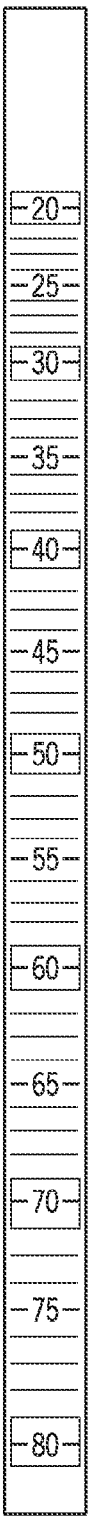
Figure 13D:
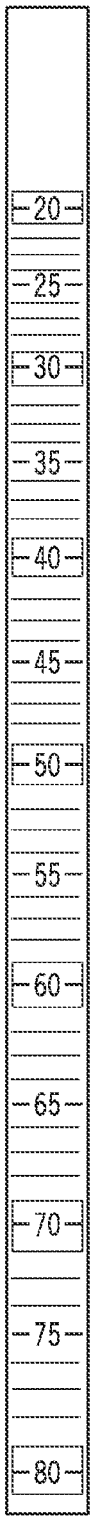

According to the invention, the sighting system works as follows. The user mounts a spool 30 having a calibration tape 112 to the wheel 28, such as that shown in FIG. 12, applied to the spool 30. The calibration tape 112 is marked in any suitable increment. In the embodiment shown, the calibration tape 112 is marked terms of relative angles, that is, relating the rotational position of the wheel 28 to the amount of angle of tilt imparted by the sighting system 10, one scale in minutes of angle, and another scale with quarter-minutes of angle. However, other increments would work as well. Alternatively the calibration markings could be applied directly to a calibration spool 30*a*.

Figure 15:
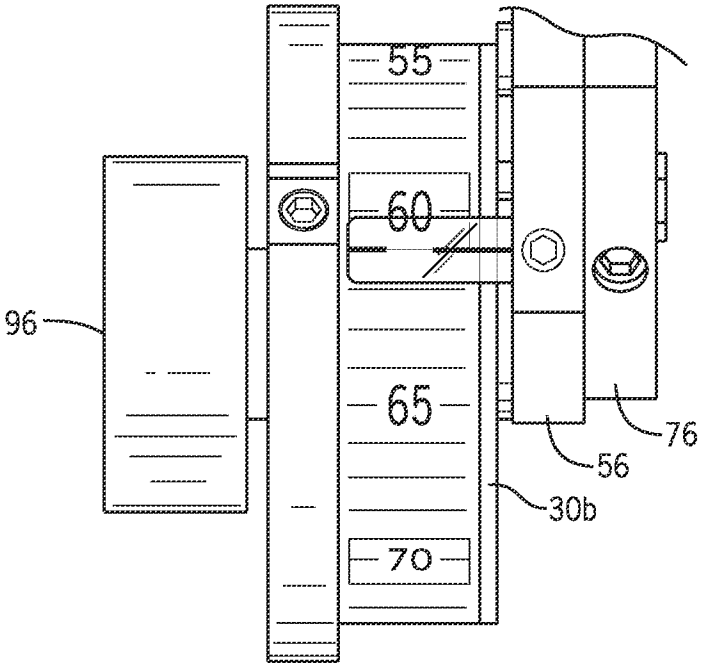
FIG. 15 is a top plan view of a portion of the sight mounting system according to the present invention, having applied thereto a spool carrying a yardage tape.
Figure 14:
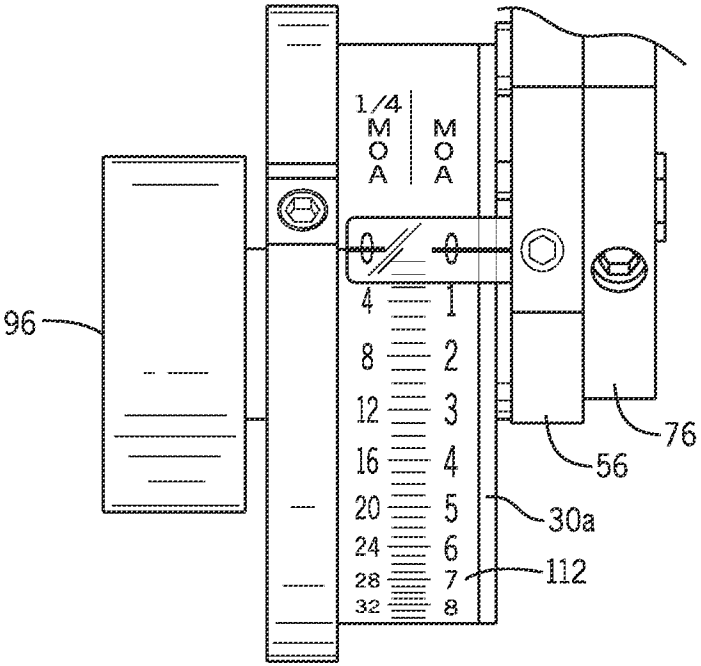
FIG. 14 is a top plan view of a portion of the sight mounting system of the present invention, having applied thereto a spool carrying a calibration tape.

In the most preferred embodiment, the user starts by setting the calibration spool 30*a* so that the zero point on the calibration tape 112 is under the line 52 of the prism 50 as seen in FIG. 14. This setting corresponds to the lowest elevation of the breech end of the rail 22 over the base 24, and the cam follower 68 being at one extreme end of the groove 66. The user then selects a target at a known minimum distance and, by reiteratively shooting at the target, each time adjusting the scope settings but not the position of the calibration spool, so as to most precisely hit the target. Next, the user selects a target at a known distance which is greater than the first distance, such as the maximum anticipated shooting distance. Without adjusting the settings of the scope in any way, the user adjusts the angle solely by rotating the calibration spool 30*a*. Once thus sighted in, the line 52 of the prism 50 will be pointing at a particular number on the calibration tape 112. The difference between the first calibration number and the second is the gap number. Using the gap number, the user then selects a yardage tape (a few examples of which are shown in FIGS. 13A through 13D) having the same number as the gap number, and applies it to the second yardage spool 30*b*, which thereby becomes the yardage spool such as shown in FIG. 15. By following these steps, the shooter can prepare a number of different yardage spools 30*b*, for different loads, projectiles, guns and other factors the shooter may want to take into account, and easily switch from one type of shooting to another, and thus from one spool to another, without any loss in accuracy. As described above and as shown in more detail in FIG. 5, each spool 30 is fastened to the wheel 28 by means of set screws 36. The user may then rotate the spool 30 to the yardage that is the distance to the target and have great accuracy.

It is also useful that a particular amount of rotation of the wheel 28 results in a reproducible amount of raising or lowering of the rail 22 with respect to the base 24. In order to accomplish this relative movement, as shown in FIGS. 6 and 7, a silicone washer 114 is slid onto the cam follower 68 and then a metal washer 116 is threaded onto the cam follower 68, although washers of other materials may be used such as rubber and plastic respectively. The metal washer 116 has at least one hole at its circumference such that when it is tightened down onto the silicone washer 114, the silicone washer 114 is squeezed into the hole(s) of the metal washer 116. This configuration prevents any rotating or side to side movement of the cam follower 68, and permits only vertical movement as the wheel 28 is rotated. In addition, in this embodiment, as shown in FIGS. 16, 16A, 17 and 17A, one or more springs 118 are positioned between the base 24 and the rail 22, biasing apart the base 24 and rail 22. This structure results in the cam follower 68 always riding on the outer surface of the groove 66, thereby improving precision and accuracy.

Figure 16:
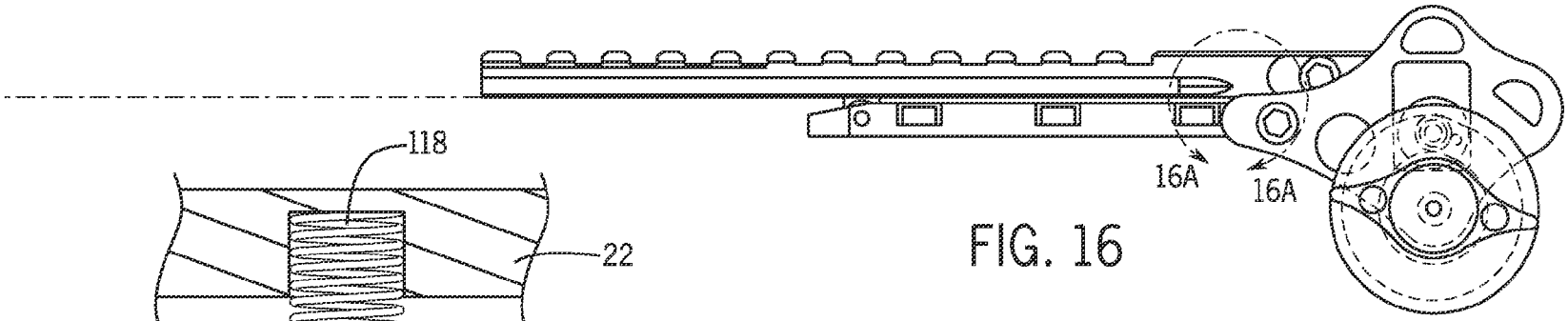
FIG. 16 is a side elevation view of the sight mounting system according to several of the embodiments of the invention, showing the wheel rotated to one extreme of the groove, and the rail and base at maximum separation.
Figure 16A:
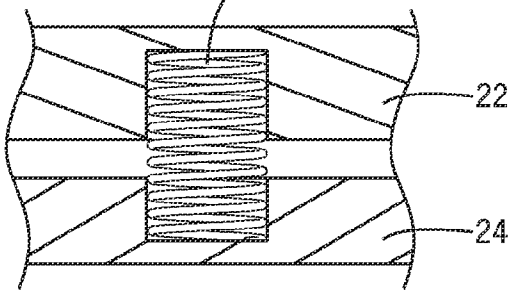
FIG. 16A is an enlarged cutaway view of a portion of the sight mounting system shown in FIG. 16, showing the spring in an expanded condition.

As seen in FIG. 16, when the wheel 28 is turned completely to one end of the groove 66, the rail 22 and the base 24 are separated by the springs 118 to the maximum extent. Because the rail 22 and the base 24 are also connected by a pivotable mounting 26, this configuration also corresponds to the most amount of angle between the rail 22 and the base 24. FIG. 16A shows the spring 118 fully separating the rail 22 and the base 24.

Figure 17:
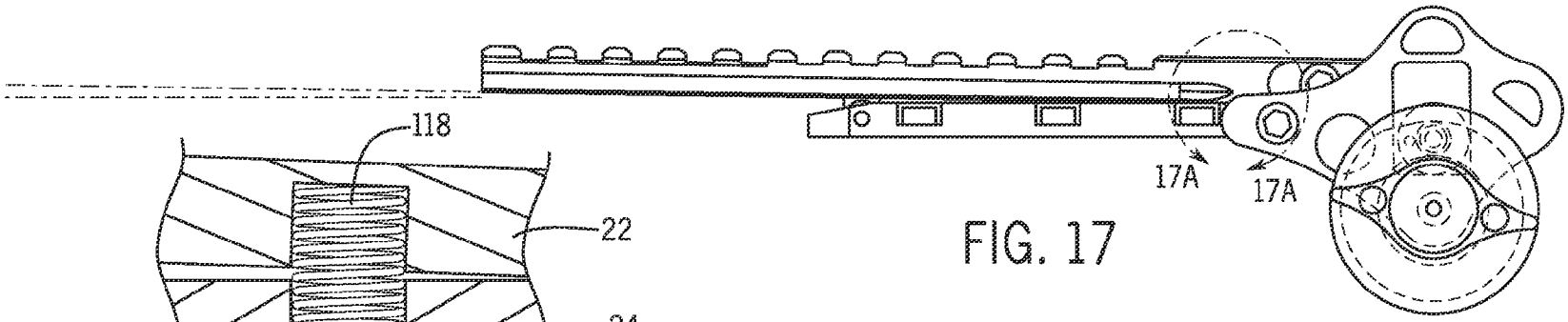
FIG. 17 is a side elevation view of the sight mounting system shown in FIG. 16, showing the wheel rotated to an opposite extreme of the groove, and the rail and base at minimum separation.
Figure 17A:
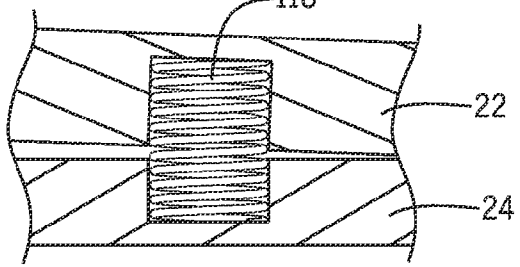
FIG. 17A is an enlarged cutaway view of a portion of the sight mounting system shown in FIG. 17, showing the spring in a compressed condition.

As seen in FIG. 17, when the wheel 28 is turned completely to the other end of the groove 66, the rail 22 and the base 24 are separated by the springs 118 to the minimum extent. This configuration also corresponds to the least amount of angle between the rail 22 and the base 24. FIG. 17A shows the spring 118 fully compressed between the rail 22 and the base 24.

Figure 19:
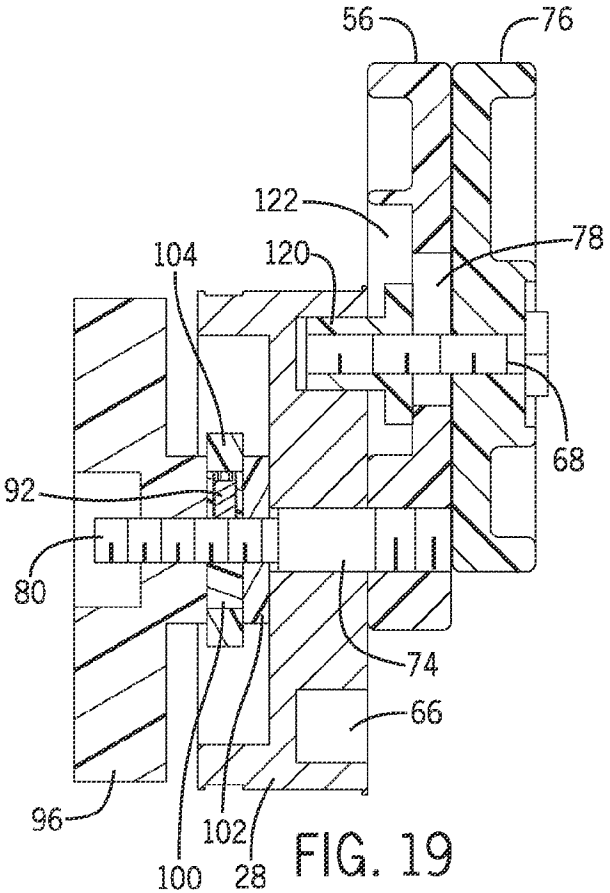
FIG. 19 is a sectional view of the sight mounting system shown in FIG. 18, taken along lines 19-19.

In an alternate embodiment shown in FIGS. 18 and 19, the cam follower 68 is mounted to or integrally formed with a cam base 120 which is square, or at least has sides that securely engage the sides of the cam window 122 so as to prevent any rotating or side to side movement of the cam follower 68, and permitting only vertical movement as the wheel 28 is rotated.

While the invention has been described with reference to preferred embodiments, it is to be understood that the invention is not intended to be limited to the specific embodiments set forth above. Thus, it is recognized that those skilled in the art will appreciate that certain substitutions, alterations, modifications, and omissions may be made without departing from the spirit or intent of the invention. Accordingly, the foregoing description is meant to be exemplary only, the invention is to be taken as including all reasonable equivalents to the subject matter of the invention, and should not limit the scope of the invention set forth in the following claims.

What is claimed is:

1. A sight mounting system comprising:

a rail with a first post extending therefrom;

a base with a second post extending therefrom, the base having a window formed therein with at least two sides, wherein the first post extends through the window and the rail is connected to the base such that the rail may be adjusted with respect to the base;

a wheel with a groove for engaging the first post and a hole for engaging the second post, the groove having an eccentric radius such that when the wheel is rotated, the engagement between the first post and the groove causes the rail to be adjusted; and a post base with at least two sides, the post base engaging the first post and sized to fit within the window such that the at least two sides of the post base contact the at least two sides of the window to prevent lateral movement.

2. A sight mounting system comprising:

a rail with a first post extending therefrom;

a base with a second post extending therefrom, the base having a window formed therein, wherein the first post extends through the window and the rail is connected to the base such that the rail may be adjusted with respect to the base;

a wheel with a groove for engaging the first post and a hole for engaging the second post, the groove having an eccentric radius such that when the wheel is rotated, the engagement between the first post and the groove causes the rail to be adjusted;

a first nut engaging the second post such that the first nut secures the wheel with respect to the second post while still allowing the wheel to rotate;

at least one washer with an opening that is sized and shaped such that the first nut may fit at least partially in the opening; and a second nut engaging the second post such that when the second nut is tightened it contacts the washer and prevents the wheel from rotating and when loosened frees the washer allowing the wheel to rotate.

3. The sight mounting system of claim 2 wherein the first nut is a square nut, the square nut further comprising:

a bore extending from a side of the square nut; and a screw sized to engage the bore, the square nut configured such that when the screw engages the bore, the square nut is secured on the second post.

* * * * *